US012660923B2

(12) United States Patent
Temple

(10) Patent No.: US 12,660,923 B2
(45) Date of Patent: Jun. 23, 2026

(54) GLIDER SEATING UNIT WITH SELECTIVELY POWERED GLIDING MOTION

(71) Applicant: L&P Property Management Company, South Gate, CA (US)

(72) Inventor: Benjamin Temple, Miami, OK (US)

(73) Assignee: L & P Property Management Company, Carthage, MO (US)

( * ) Notice: Subject to any disclaimer, the term of this patent is extended or adjusted under 35 U.S.C. 154(b) by 238 days.

(21) Appl. No.: 18/754,380

(22) Filed: Jun. 26, 2024

(65) Prior Publication Data

US 2026/0000200 A1 Jan. 1, 2026

(51) Int. Cl.

| | |
|---|---|
| ***A47C 1/03*** | (2006.01) |
| ***A47C 3/025*** | (2006.01) |
| *A47C 1/032* | (2006.01) |
| *A47C 1/0355* | (2013.01) |
| *A47C 17/04* | (2006.01) |

(52) U.S. Cl.

CPC ..... *A47C 3/0255* (2013.01); *A47C 3/0251* (2018.08); *A47C 1/03211* (2013.01); *A47C 1/0355* (2013.01); *A47C 17/04* (2013.01)

(58) Field of Classification Search

CPC . A47C 1/0355; A47C 1/0242; A47C 1/03211; A47C 1/0345; A47C 1/0352; A47C 17/86; A47C 17/04; A47C 17/162; A47C 3/0255; A47C 3/0251

See application file for complete search history.

(56) References Cited

U.S. PATENT DOCUMENTS

| | | | | |
|---|---|---|---|---|
| 3,758,156 | A | 9/1973 | Zawadzki | |
| 5,765,913 | A | 6/1998 | LaPointe et al. | |
| 8,398,168 | B2 | 3/2013 | Lawson | |
| 8,398,169 | B2 | 3/2013 | LaPointe | |
| 8,459,732 | B2 | 6/2013 | LaPointe et al. | |
| 8,696,053 | B2 | 4/2014 | LaPointe | |
| 8,833,844 | B2 | 9/2014 | LaPointe et al. | |
| 10,524,574 | B2 * | 1/2020 | LaPointe | A47C 1/0352 |
| 11,229,290 | B1 | 1/2022 | Bryant | |
| 11,266,245 | B2 * | 3/2022 | Lawson | A47C 1/0355 |
| 12,588,765 | B2 * | 3/2026 | Lapointe | A47C 1/0355 |

* cited by examiner

*Primary Examiner* — Syed A Islam

(74) *Attorney, Agent, or Firm* — Wood Herron & Evans LLP

(57) ABSTRACT

A glider seating unit with a selectively powered gliding motion is provided. The glider seating unit includes a base frame and a glide assembly movably connected to the base frame. The glide assembly is configured to glide in a forward direction and in a backward direction relative to the base frame. A glider drive mechanism is connected to the base frame and includes a motor, a drive shaft connected to the motor, a crankshaft releasably connected to the drive shaft at a joint, and a linkage connected between the crankshaft and the glide assembly. Operation of the motor in a first rotational direction connects the drive shaft to the crankshaft to rotate the crankshaft to thereby induce reciprocating forward and backward gliding motion of the glide assembly relative to the base frame. Operation of the motor of the glider drive mechanism in an opposite, second rotational direction disconnects the drive shaft from the crankshaft to permit the glide assembly to glide freely forward and backward relative to the base.

26 Claims, 12 Drawing Sheets

GLIDER SEATING UNIT WITH SELECTIVELY POWERED GLIDING MOTION

FIELD OF THE INVENTION

This invention generally relates to furniture and seating products, and more particularly, to motion furniture and seating products with a powered gliding motion.

BACKGROUND OF THE INVENTION

Conventional motion seating furniture, such as chairs, sofas, loveseats, and similar furniture items, may either recline or be fixed upright and are often classified by their motion type, which includes either rocking or gliding motions. Gliding motion furniture, otherwise referred to as glider seating units, glide forward and backward from a neutral position due to the force exerted by the occupant. This gliding motion is distinct from the rocking motion of a rocker seating unit. In that regard, rocker seating units are typically configured to rock back and forth around a pivot point. This motion is typically achieved by a curved base or a system of springs and pivoting linkages that create a rocking arc, for example.

For conventional glider seating units in particular, the occupant initiates and maintains the gliding motion by shifting their weight or pushing off from the ground or other surface with their feet. While this occupant-powered gliding motion offers a smooth and soothing experience that many users find enjoyable and relaxing, it requires continuous physical effort from the occupant. This can be a limitation for some users, particularly those with limited mobility or strength. Consequently, there is a growing need for a mechanically powered gliding motion to enhance user convenience and accessibility for glider seating units.

In view of the above, it is therefore an objective of this invention to provide a glider seating unit with a mechanically powered gliding motion. It is further an objective of this invention to provide a glider seating unit with the capability to selectively switch between a powered gliding mode, in which the gliding motion of the unit is mechanically powered, and a free gliding mode, in which the gliding motion is occupant-powered.

SUMMARY OF THE INVENTION

According to one aspect of the invention, a glider seating unit is provided. The glider seating unit includes a base frame, a glide assembly connected to the base frame, the glide assembly being configured to glide in a forward direction and in a backward direction relative to the base frame, and a glider drive mechanism connected to the base frame. The glider drive mechanism includes a motor, a drive shaft connected to the motor, a crankshaft releasably connected to the drive shaft at a joint, and a linkage connected between the crankshaft and the glide assembly. The glider drive mechanism is configured to be operated to connect the crankshaft to the drive shaft such that operation of the motor induces reciprocating forward and backward gliding motion of the glide assembly relative to the base frame. Additionally, the glider drive mechanism is configured to be operated to disconnect the drive shaft from the crankshaft to permit the glide assembly to glide freely forward and backward relative to the base frame.

According to one embodiment of the invention, operation of the motor of the glider drive mechanism in a first rotational direction may be configured to connect the drive shaft to the crankshaft to rotate the crankshaft to induce reciprocating forward and backward gliding motion of the glide assembly relative to the base frame. Additionally, operation of the motor of the glider drive mechanism in an opposite, second rotational direction may be configured to disconnect the drive shaft from the crankshaft to permit the glide assembly to glide freely forward and backward relative to the base frame.

According to another embodiment of the invention, the crankshaft may include a main shaft and a crankpin journal offset from the main shaft to define a crank throw. The linkage may be connected to the crankpin journal of the crankshaft. In yet another embodiment, the connection between the drive shaft and the crankshaft may be threaded such that operation of the motor of the glider drive mechanism in the first rotational direction causes the drive shaft to threadedly engage the crankshaft and operation of the motor of the glider drive mechanism in the second rotational direction causes the drive shaft to unthread from the crankshaft. For example, the crank shaft may include a threaded socket that is configured to threadedly receive an externally threaded male connector of the drive shaft at the joint.

In yet another embodiment, the glider drive mechanism may further include a first support bracket and a second support bracket. The first support bracket may include a bearing assembly and may be connected to the base frame. The second support bracket may include a bearing assembly and may be connected to the base frame. In that regard, a first end of the crankshaft may be rotatably supported by the first support bracket and a second end of the crankshaft may be rotatably supported by the second support bracket. In one embodiment, the glide assembly may include a first glide bracket and a second glide bracket. The first support bracket may be connected to the first glide bracket and the second support bracket may be connected to the second glide bracket. In another embodiment, the motor may be attached to the first glide bracket with a motor support bracket. Further, the first glide bracket may be located on a first side of the glider seating unit and the second glide bracket may be located on an opposite, second side of the glider seating unit such that a rotational axis of the crankshaft is generally perpendicular to the first side and the second side of the glider seating unit.

In one embodiment, the first glide bracket and the second glide bracket may each include at least one swing link. The glide assembly may further include at least one cross brace connected between the at least one swing link of the first glide bracket and the at least one swing link of the second glide bracket. The linkage may be connected between the crankshaft and the at least one cross brace.

In yet another embodiment, the glider drive mechanism may further comprise a spring disposed on the drive shaft. The spring may be positioned between the motor and a collar on the drive shaft to bias the drive shaft into engagement with the crankshaft. In one embodiment, the glider seating unit may include a seating unit connected to the glide assembly. The seating unit may be movable between an upright position and a reclined position. The seating unit may be stopped at any position between the upright position and the reclined position. In another embodiment, the glider drive mechanism may be configured to be operated to connect the drive shaft to the crankshaft when the seating unit is moved to the reclined position.

According to another aspect of the invention, a method of operating a glider seating unit is disclosed. The method include providing the glider seating unit according to any of the embodiments described above and operating the motor of the glider drive mechanism to rotate the drive shaft in a first rotational direction to connect the drive shaft to the crankshaft. The method further includes operating the motor in the first rotational direction to induce reciprocating forward and rearward gliding motion of the glide assembly relative to the base frame. Then, operating the motor in a second rotational direction to disconnect the drive shaft from the crankshaft to permit the glide assembly to glide freely forward and backward relative to the base frame.

According to one embodiment, the connection between the drive shaft and the crankshaft may be threaded. The method may further include operating the motor in the first rotational direction to threadedly engage the drive shaft to the crankshaft and operating the motor in the second rotational direction to unthread the drive shaft from the crankshaft. For example, operating the motor in the second rotational direction to unthread the drive shaft from the crankshaft may result in the drive shaft only partially unthreading from the crankshaft.

In yet another embodiment, the glider seating unit may include a seating unit connected to the glide assembly. The seating unit may be movable between an upright position and a reclined position. The seating unit may be stopped at any position between the upright position and the reclined position. The method may further include moving the seating unit to the reclined position and operating the motor of the glider drive mechanism to rotate the drive shaft in the first rotational direction to connect the drive shaft to the crankshaft to prevent the glide assembly from freely gliding forward and backward relative to the base frame when the seating unit is in the reclined position. In one embodiment, operating the motor in the first rotational direction to induce reciprocating forward and rearward gliding motion of the glide assembly relative to the base frame may be done while the seating unit is in the reclined position. In yet another embodiment, the method includes moving the seating unit to the upright position and operating the motor in the second rotational direction to disconnect the drive shaft from the crankshaft to permit the glide assembly to glide freely forward and backward relative to the base frame while the seating unit is in the upright position.

According to another aspect of the invention, a glider drive mechanism for a glider seating unit is provided. The glider seating unit may include a base frame and a glide assembly movably connected to the base frame. The glide assembly may be configured to glide in a forward direction and in a backward direction relative to the base frame. The glider drive mechanism includes a motor connected to the base frame, a drive shaft connected to the motor, a crankshaft releasably connected to the drive shaft at a joint, and a linkage configured to be connected between the crankshaft and the glide assembly of the glider seating unit. The glider drive mechanism is configured to be operated to connect the crankshaft to the drive shaft such that operation of the motor is configured to induce reciprocating forward and backward gliding motion of the glide assembly relative to the base frame. Additionally, the glider drive mechanism is configured to be operated to disconnect the drive shaft from the crankshaft such that the glide assembly is configured to glide freely forward and backward relative to the base frame.

According to one embodiment, operation of the motor of the glider drive mechanism in a first rotational direction may be configured to connect the drive shaft to the crankshaft to rotate the crankshaft to induce reciprocating forward and backward gliding motion of the glide assembly relative to the base frame. Additionally, operation of the motor of the glider drive mechanism in an opposite, second rotational direction may be configured to disconnect the drive shaft from the crankshaft to permit the glide assembly to glide freely forward and backward relative to the base frame. For example, the crankshaft may include a main shaft and a crankpin journal offset from the main shaft to define a crank throw. The linkage may be connected to the crankpin journal of the crankshaft.

In another embodiment, the connection between the drive shaft and the crankshaft may be threaded such that operation of the motor of the glider drive mechanism in the first rotational causes the drive shaft to threadedly engage the crankshaft and operation of the motor of the glider drive mechanism in the second rotational direction causes the drive shaft to unthread from the crankshaft. For example, the crank shaft may include a threaded socket that is configured to threadedly receive an externally threaded male connector of the drive shaft at the joint.

In yet another embodiment, the glider drive mechanism may further include a first support bracket and a second support bracket. The first support bracket may include a bearing assembly and may be connected to the base frame. The second support bracket may include a bearing assembly and may be connected to the base frame. In that regard, a first end of the crankshaft may be rotatably supported by the first support bracket and a second end of the crankshaft may be rotatably supported by the second support bracket. In one embodiment, the glider drive mechanism may include a spring disposed on the drive shaft. The spring may be positioned between the motor and a collar on the drive shaft to bias the drive shaft into engagement with the crankshaft.

The accompanying drawings, which are incorporated in and constitute part of this specification, illustrate embodiments of the invention and, together with the summary of the invention given above, and the detailed description of the drawings given below, explain the principles of the present invention.

DETAILED DESCRIPTION OF THE INVENTION

Various embodiments will be further clarified by examples in the description below. In general, aspects of the present invention are directed to a glider seating unit having a selectively powered gliding motion. The glider seating unit may be a recliner seating unit or a fixed upright seating unit. In either case, the glider seating unit is configured to glide forward and backward from a neutral position, either by occupant power or mechanical power.

According to aspects of the invention, the glider seating unit includes a glider drive mechanism that is operable to selectively power the gliding motion of the glider seating unit. That is, an occupant may choose to place the glider seating unit in a powered gliding mode, where the gliding motion is mechanically powered or driven by the glider drive mechanism. Powered gliding motion is defined herein as motion which does not require additional force or input by an occupant of the furniture member to generate gliding motion of the seating unit.

The occupant may alternatively operate the glider drive mechanism to place the glider seating unit in a free gliding mode, where the gliding motion is unpowered and may be induced by the occupant, for example. While aspects of the present invention will be described in the context of specific seating and furniture products, it should be appreciated that other furniture items, such as chairs, sofas, loveseats, and similar products with gliding motion, may also benefit from aspects of the present invention. The drawings are not intended to be limiting in this regard.

Figure 1:
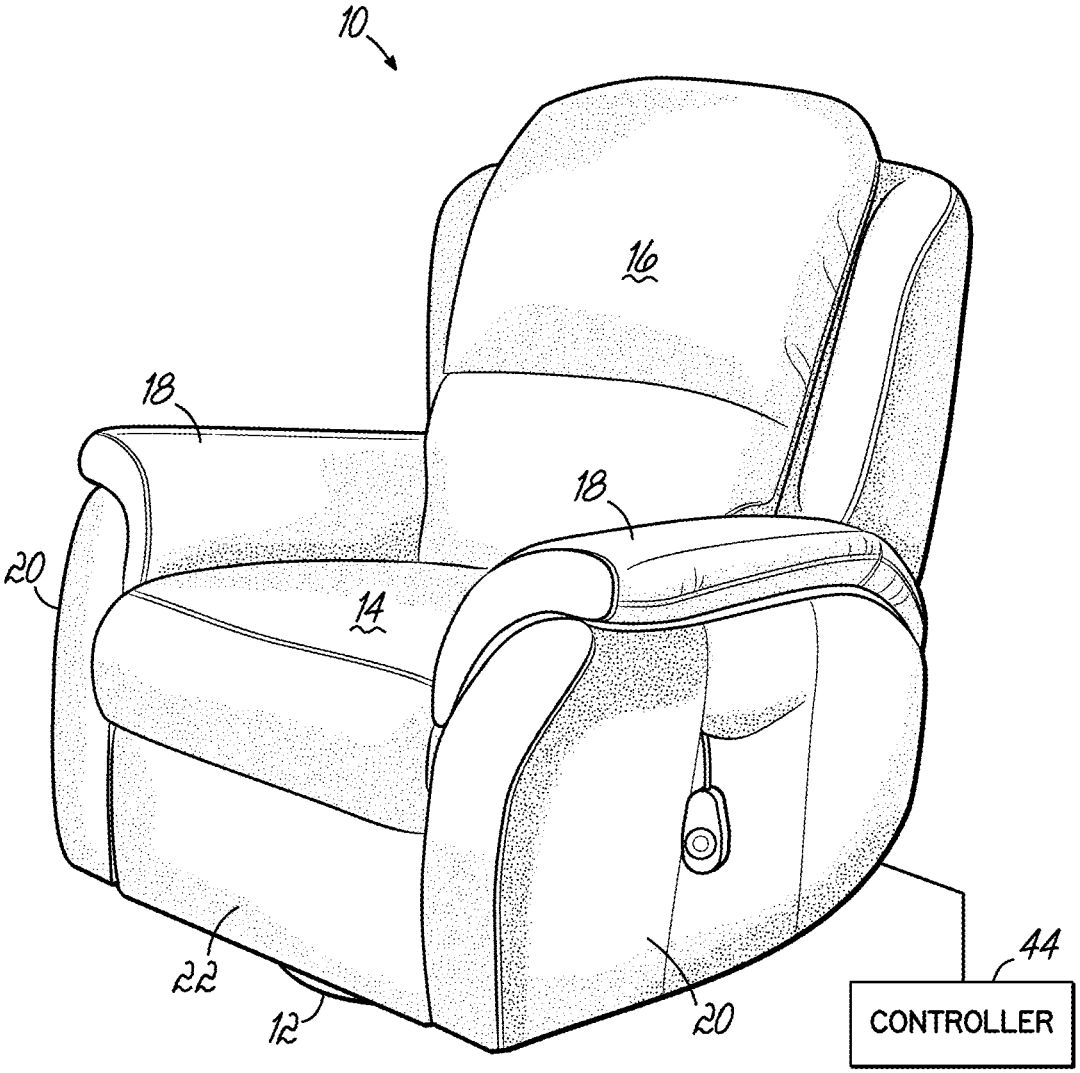
FIG. 1 is a perspective view of an exemplary glider seating unit equipped with a glider drive mechanism according to an embodiment of the invention.

Referring now to the Figures, FIG. 1 illustrates a gliding, reclining seating unit 10, referred to herein as a glider seating unit 10, incorporating the principles of the present invention. The glider seating unit 10 includes a base 12 that supports a seat 14, a backrest 16, arms 18 on opposite sides 20 of the glider seating unit 10, and a footrest 22. The footrest 22 is considered at the front of the glider seating unit 10, and the backrest 16 is considered at the rear of the glider seating unit 10. The glider seating unit 10 is configured to support an occupant and may be actuatable between an upright position, as shown, and a reclined position. That is, the exemplary glider seating unit 10 is a recliner. The seating unit 10 may be stopped at any position between the upright position and the reclined position. However, the glider seating unit 10 may alternatively be a fixed upright seating unit. The glider seating unit 10 is configured to glide or move in a forward direction and in a backward direction from the neutral position shown in FIG. 1. To that end, the glider seating unit 10 is not a rocker seating unit, for example.

Figure 2:
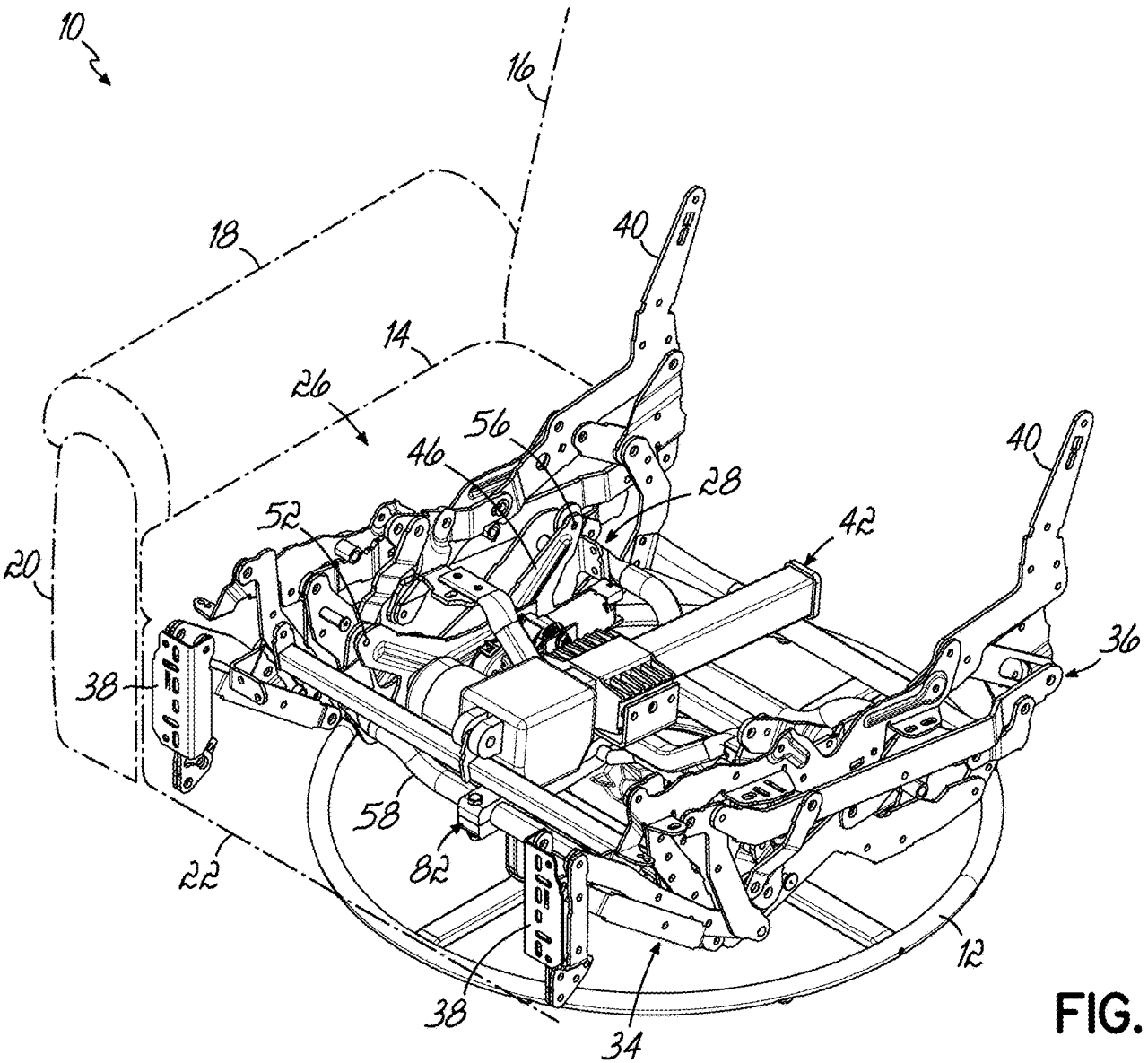
FIG. 2 is a schematic perspective view of the glider seating unit of FIG. 1, illustrating details of a base frame, a glide assembly, and a seating unit of the glider seating unit, with the seating unit in an upright position.
Figure 3:
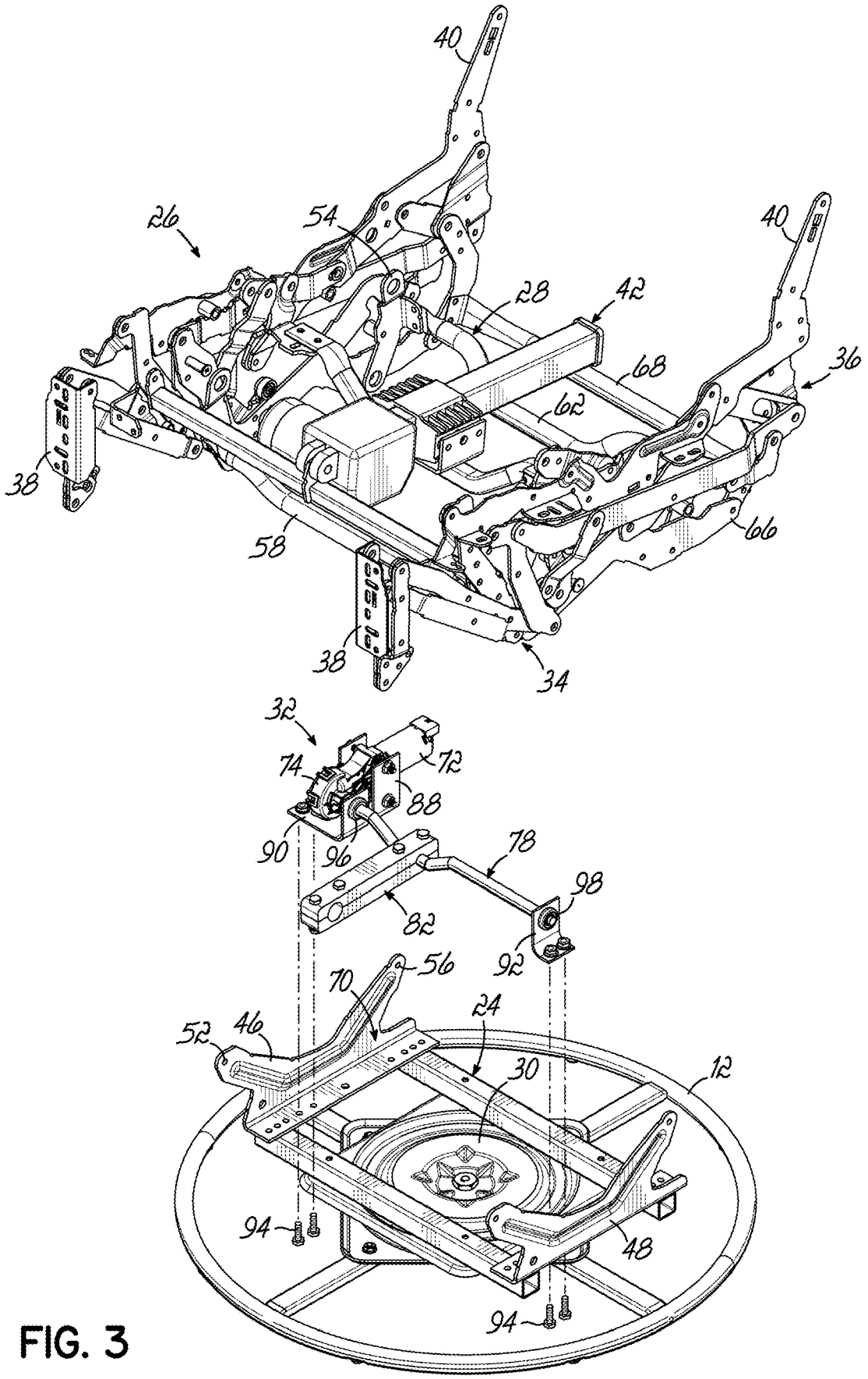
FIG. 3 is a partial disassembled perspective view illustrating additional details of the base frame, glide assembly, seating unit, and glider drive mechanism of the glider seating unit of FIGS. 1 and 2.

FIGS. 2-5 show the glider seating unit 10 with the seat 14, backrest 16, footrest 22, and arms 18 in dashed lines to reveal details of the construction of the underlying components. As shown in FIG. 3, the glider seating unit 10 includes a base frame 24 connected to the base 12 and a seating unit 26 movably connected to the base 12 frame via a glide assembly 28. The circular base 12 may alternatively be square, rectangular, ovular, or other shapes, for example. The base frame 24 may be connected to the base 12 with a bearing assembly 30 that permits the base frame 24 to swivel relative to the base 12. The glide assembly 28 permits the seating unit 26 to move back and forth in a gliding motion relative to the base 12 and the base frame 24. The glider seating unit 10 further includes a glider drive mechanism 32 connected to the base frame 24 and the glide assembly 28 and being operable to selectively induce reciprocating forward and backward gliding motion of the glide assembly 28 and thus the seating unit 26 relative to the base frame 24, as will be described in further detail below.

With reference to FIGS. 2 and 3, the seating unit 26 includes a footrest assembly 34 and a seat adjustment assembly 36. The footrest assembly 34 is comprised of a plurality of links arranged to extend and collapse a pair of footrest support arms 38 to which the footrest 22 of the glider seating unit 10 is attached. The seat adjustment assembly 36 is connected to the footrest assembly 34 and comprises a plurality of links arranged to recline and incline a pair of back support members 40 to which the backrest 16 of the glider seating unit 10 is attached. The exemplary seating unit 10 may be referred to as a recliner assembly, for example. Connected between the seat adjustment assembly 36 and the footrest assembly 34 is a motor assembly 42 which provides powered adjustment of the glider seating unit 10 between an upright position and a reclined position. The seating unit 10 may be stopped at any position between the upright position and the reclined position. The glider seating unit 10 may include a controller 44 (FIG. 1) operatively connected to the motor assembly 42 for controlling a reclined position of the seating unit 26. The controller 44 may be removably or fixedly located on a side 20 of the glider seating unit 10, for example. Regardless, when in the upright position, the footrest 22 is collapsed and the backrest 16 is inclined. When in the reclined position, the footrest 22 may be extended by actuating the footrest assembly 34 via the motor assembly 42, and the backrest 16 may be reclined by actuating the seat adjustment assembly 36 via the motor assembly 42. While the glider seating unit 10 is shown with a motor assembly 42, it will be understood that a non-motorized mechanism, such as a spring-assisted mechanism or gas or hydraulic system may be used to move the glider seating unit 10 between the reclined and upright positions.

Figure 4:
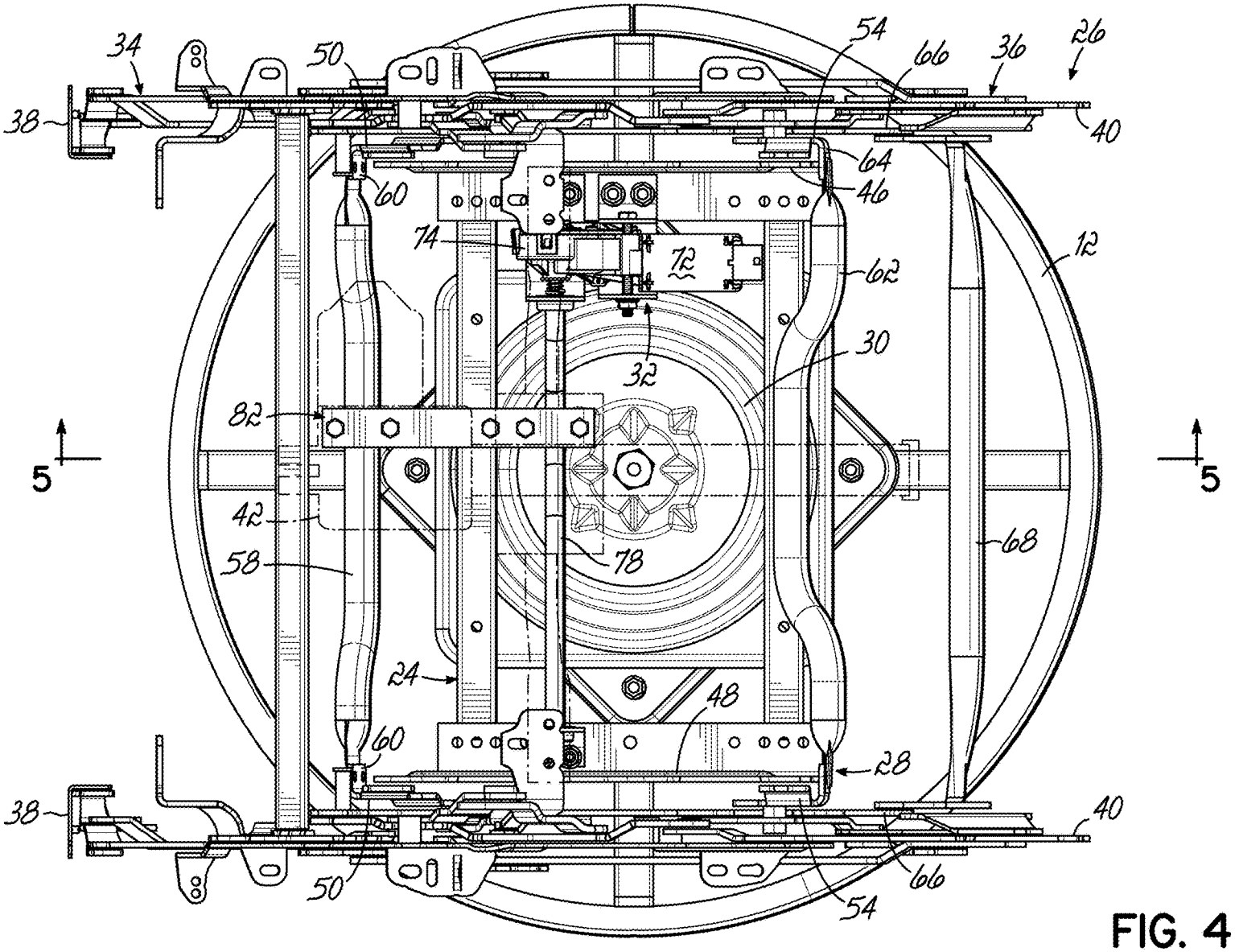
FIG. 4 is a top view of the glider seating unit of FIGS. 1-3, illustrating the base frame, glide assembly, seating unit, and glider drive mechanism assembled.
Figure 5:
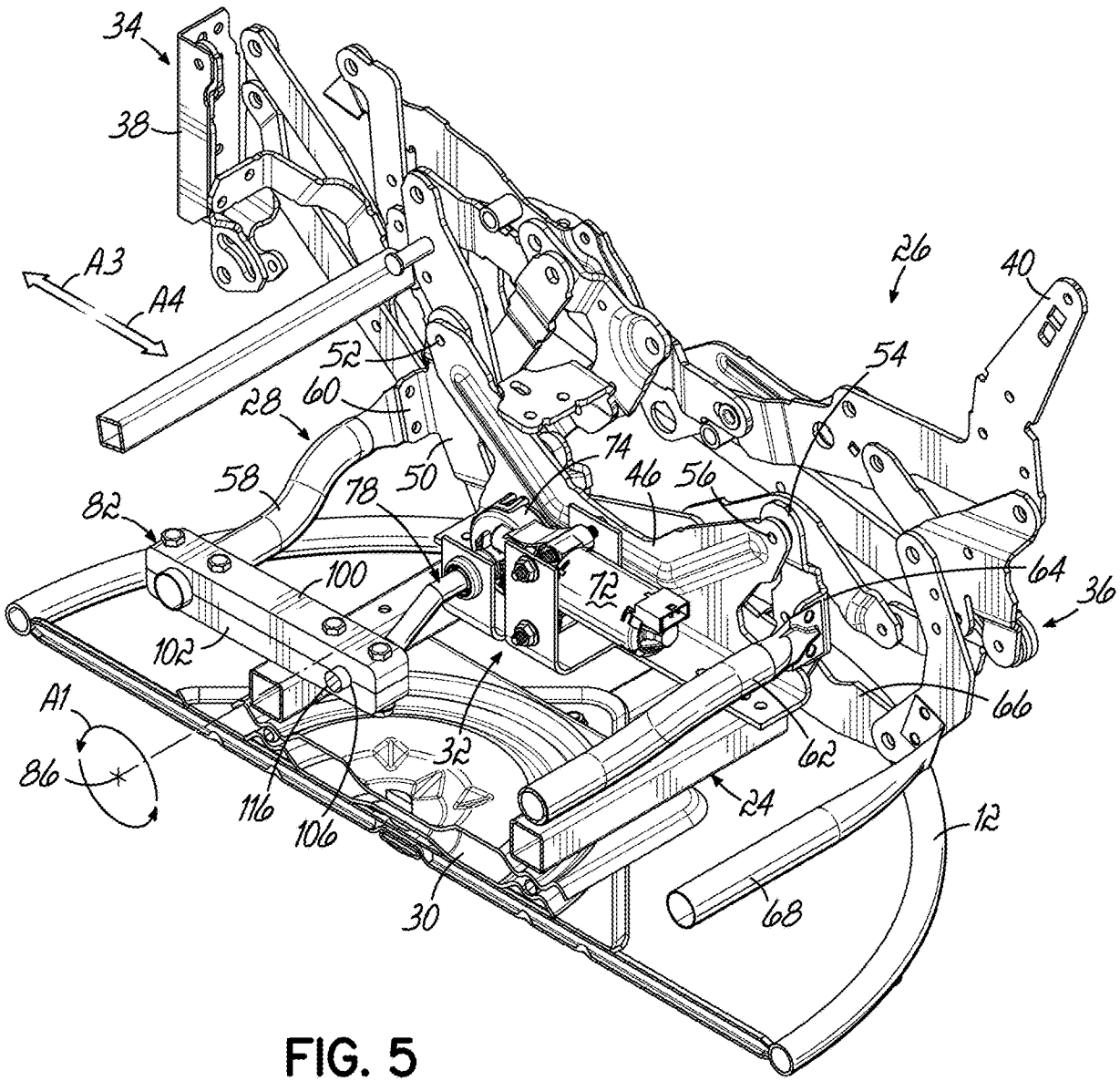
FIG. 5 is a partial cross-sectional view taken along line 5-5 of FIG. 4, illustrating the glider drive mechanism connected between the glide assembly and the base frame of the glider seating unit.

Referring now to FIGS. 3-5, the glide assembly 28 is connected between the seating unit 26 and the base frame 24 to permit gliding motion of the seating unit 26 relative to the base frame 24. As best shown in FIG. 3, the glide assembly 28 includes a pair of glide brackets 46, 48 (i.e., a right side glide bracket 46 and a left side glide bracket 48) that are spaced apart and fixedly connected to the base frame 24, such as by welding or bolting, for example. As shown, the right glide bracket 46 is located on the right side 20 of the glider seating unit 10 (i.e., from the perspective of an occupant sitting in the glider seating unit 10) and the left glide bracket 48 is positioned on the opposite, left side 20.

As best shown in FIGS. 4 and 5, each glide bracket 46, 48 includes a front swing link 50 pivotally coupled at an upper end to the top front of glide bracket 46, 48 at a pivot point 52 and a rear swing link 54 pivotally coupled at an upper end to the top rear of glide bracket 46, 48 at a pivot point 56. Coupled between the pair of front swing links 50 is a front support tube 58, otherwise referred to as a front horizontal cross brace. The front support tube 58 is fixedly coupled to each front swing link 50 via an inwardly extending tab 60 of each front swing link 50. As a result, the front support tube 58 extends generally from one side 20 of the glider seating unit 10 to the other. Similarly, coupled between the pair of rear swing links 54 is a rear support tube 62, otherwise referred to as a rear horizontal cross brace. The rear support tube 62 is fixedly coupled to each rear swing link 54 via an inwardly extending tab 64 of each rear swing link 54, and extends generally from one side 20 of the glider seating unit 10 to the other. The front and rear support tubes 58, 62 connect the front and rear swing links 50, 54 of each glide bracket 46, 48, respectively, providing stability and support to the glide assembly 28.

The glide assembly 28 further includes a pair of carrier links 66, each operatively supported by a respective glide bracket 46, 48 through the front and rear swing links 50, 54. In that regard, the lower end of the front swing link 50 is pivotally coupled to the carrier link 66 at a pivot point. Similarly, the lower end of the rear swing link 54 is coupled to the carrier link 66 at another pivot point. Each carrier link 66 is arranged outboard of the respective glide bracket 46, 48 relative to the side 20 of the glider seating unit 10. The seating unit 26 is connected to the carrier links 66, which supports and move the seating unit 26 back and forth as the front and rear swing links 50, 54 pivot or "swing" on respective glide brackets 46, 48. This movement creates the gliding motion of the glide assembly 28 and thus the seating unit 26 relative to the base frame 24. An additional support tube 68 may be connected between the pair of carrier links 66 to provide further stability and support to the glide assembly 28.

The glider drive mechanism 32 is positioned in a central space 70 between the base frame 24 and the seating unit 26, and is connected to both the base frame 24 and the glide assembly 28 to power the gliding movement of the glider seating unit 10, providing automatic reciprocating motion for the seating unit 26, referred to herein as the powered gliding mode. The glider drive mechanism 32 may be operated to a free gliding mode, in which the gliding motion is occupant-powered, as will be described in further detail below. The glider drive mechanism 32 may also be operatively connected to the controller 44 such that an occupant may switch between the powered gliding mode and the free gliding mode using the controller 44.

With continued reference to FIGS. 3-5, the glider drive mechanism 32 includes a motor 72 and a gearbox 74 connected to the motor 72 (referred to as a motor 72 and gearbox 74 combination), and a drive shaft 76 (e.g., FIG. 7) configured to be received by the gearbox 74 for rotation. Additionally, the glider drive mechanism 32 includes a crankshaft 78 that is releasably connected to the drive shaft 76 at a joint 80 (e.g., FIGS. 9A and 9B), and a linkage 82 that is configured to connect the crankshaft 78 to the glide assembly 28. As will be described in further detail below, the motor 72 drives the rotation of the drive shaft 76, which is selectively connected or disconnected (i.e., releasably connected) with the crankshaft 78 to impart rotational movement to the crankshaft 78. Rotational movement of the crankshaft 78 is transferred to linear movement of the glide assembly 28 via the linkage 82 to power the gliding movement of the glide assembly 28 and thus the seating unit 26.

The motor 72 may be an electric motor configured to be connected to a source of electric power such as a 110-volt AC outlet, for example. The motor 72 is connected to the gearbox 74 which is configured to transfer rotational motion of the motor 72 to the drive shaft 76. In other words, the motor 72 and the gearbox 74 are fixedly connected to each other such that a rotating shaft of the motor 72 rotates gears 84 of the gearbox 74 (e.g., FIGS. 8A-8C), which in turn rotate the drive shaft 76. Consequently, operating the motor 72 in one rotational direction rotates the drive shaft 76 and the crankshaft 78 in a first rotational direction about a rotational axis 86, as indicated by directional arrow A1 in FIG. 5. Operating the motor 72 in the opposite direction rotates the drive shaft 76 in a second, opposite rotational direction (e.g., A2 in FIG. 9B) about the rotational axis 86 to disconnect the drive shaft 76 from the crankshaft 78 to place the glider seating unit 10 in the free gliding mode, as will be described in further detail below. The drive shaft 76 may be considered connected to the motor 72 indirectly through the gearbox 74. However, it is within the scope of the present invention for the glider drive mechanism 32 to exclude the gearbox 74 such that the drive shaft 76 is directly connected to the motor 72.

With continued reference to FIGS. 3-5, the glider drive mechanism 32 is fixedly connected to the base frame 24 of the glider seating unit 10 with a number of brackets. In particular, the glider drive mechanism 32 is fixedly connected to the base frame 24 by a motor support bracket 88, a drive shaft support bracket 90, and a crankshaft support bracket 92. The motor support bracket 88 may be a single bracket or a pair of brackets as shown. In either case, the motor support bracket 88 is securely attached to the base frame 24, with the motor 72 and gearbox 74 combination mounted on the bracket 88, thus attaching the motor 72 and gearbox 74 combination to the base frame 24. As shown in FIG. 3, the motor support bracket 88 is configured to be fastened with appropriate fasteners 94 to one of the glide brackets 46, 48, such as the right side glide bracket 46, which is itself fixedly attached to the base frame 24. While the motor 72 and gearbox 74 of the glider drive mechanism 32 are shown as being attached to the right side glide bracket 46, it will be understood that the motor 72 and gearbox 74 may alternatively be attached to the left side glide bracket 48, for example. To that end, the motor 72 and gearbox 74 of the glider drive mechanism 32 may be installed on either side of the base frame 24. To that end, the motor 72 and gearbox 74 combination are indirectly secured or connected to the base frame 24 through one of the glide brackets 46, 48.

The drive shaft support bracket 90 is also configured to be connected to the right side glide bracket 46 with appropriate fasteners 94, such as a nut and bolt combination, as shown in FIG. 3. The drive shaft support bracket 90 includes a bearing assembly 96 that is configured to rotatably support the drive shaft 76 and the crankshaft 78. The bearing assembly 96 may be a roller bearing, for example. In particular, the drive shaft support bracket 90 supports the drive shaft 76 and the crankshaft 78 at the joint 80 therebetween. That is, the joint 80 between the drive shaft 76 and the crankshaft 78 is made at the drive shaft support bracket 90 and generally through the bearing assembly 96. To that end, the bearing assembly 96 maintains alignment between the drive shaft 76 and the crankshaft 78, particularly while the drive shaft 76 and the crankshaft 78 are disconnected to place the glider drive mechanism 32 in free gliding mode.

The crankshaft support bracket 92 is configured to be connected to the left side glide bracket 48 with appropriate fasteners 94, as shown in FIGS. 3 and 4. The drive shaft support bracket 92 includes a bearing assembly 98 that is configured to rotatably support the crankshaft 78. The bearing assembly 98 may be a roller bearing, for example. In that regard, the crankshaft 78 is rotatably supported by, and spans between, the drive shaft support bracket 90 and the crankshaft support bracket 92. The brackets 90, 92 may be attached to the pair of glide brackets 46, 48 at any location between the front support tube 58 and the rear support tube 62. In the embodiment shown, the glider drive mechanism 32 is mounted so as to be generally centered between the front support tube 58 and the rear support tube 62. In any case, the crankshaft 78 generally spans between the pair of glide brackets 46, 48 and, consequently, the sides 20 of the glider seating unit 10. As a result, and as shown in FIGS. 4 and 5, the rotational axis 86 of the crankshaft 78 and the drive shaft 76 is generally perpendicular to the sides 20 of the glider seating unit 10, as generally represented by the glide brackets 46, 48 which align with the sides 20 of the glider seating unit 10.

To mount the glider drive mechanism 32 in the central space 70 between the base frame 24 and the seating unit 26, the glider drive mechanism 32 is fixedly connected to the base frame 24 using brackets 88, 90, 92 as described above. The linkage 82 is then connected between the crankshaft 78 and one of the front or rear support tubes 58, 62. As shown in FIG. 4, the entirety of the glider drive mechanism 32 remains in the central space 70 between the base frame 24 and the seating unit 26, providing no occurrences of adverse visible components. In the exemplary embodiment shown, the linkage 82 is connected between the crankshaft 78 and the front support tube 58. When the motor 72 rotates the crankshaft 78 in the first rotational direction A1, the crankshaft 78 generates reciprocating linear motion of the linkage 82, resulting in the linear motion of the glide assembly 28 and the seating unit 26. Thus, the linkage 82 effectively translates the rotational motion of the crankshaft 78 into the reciprocating linear movement of the glide assembly 28, enabling the powered gliding mode of the glider seating unit 10. To that end, the crankshaft 78 moves only rotationally, while the linkage 82 moves linearly. As shown in FIG. 5, linear movement of the glide assembly 28 consists of the glide assembly 28 gliding in a forward direction, as indicated by directional arrow A3, and in a backward or rearward direction, as indicated by directional arrow A4, relative to the base frame 24. As will be described in further detail below, the drive shaft 76 may be disconnected from the crankshaft 78 at the joint 80 to permit the glide assembly 28 to glide freely in the forward direction A3 and in the backward direction A4 relative to the base frame 24.

Figure 6:
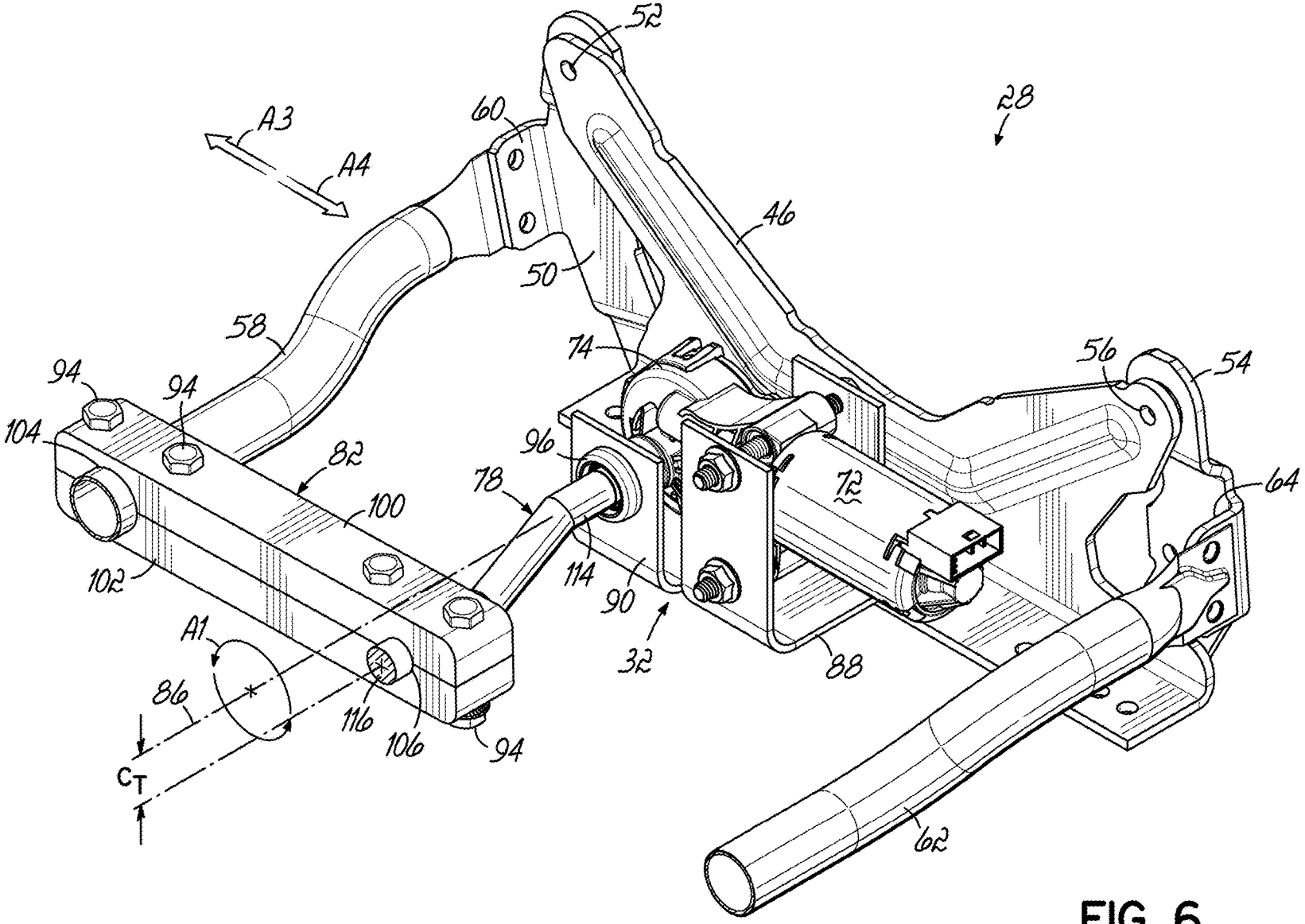
FIG. 6 is a partial cross-sectional view of the glider drive mechanism of FIGS. 1-5, illustrating additional details of a motor, crankshaft, and linkage of the glider drive mechanism.

The linkage 82 may comprise any suitable component, such as a coupling rod or block, for example, to connect the crankshaft 78 to one of the support tubes 58, 62 to convey rotational movement of the crankshaft 78 into the linear motion of the glide assembly 28. As shown in FIGS. 5 and 6, the linkage 82 includes two linkage halves 100, 102, such as an upper linkage half 100 and a lower linkage half 102, that fit together to connect the crankshaft 78 to the front support tube 58. In particular, the two linkage halves 100, 102 fit together to form a first bore 104 and a second bore 106 through the linkage 82. In that regard, each linkage half 100, 102 contains half of each bore 104, 106, allowing the two halves 100, 102 to be assembled around the crankshaft 78 and the front support tube 58. When brought together, the bore halves align to create complete circular bores 104, 106 around the crankshaft 78 and the front support tube 58 to operatively connect the crankshaft 78 to the front support tube 58. Specifically, the front support tube 58 is received through the first bore 104 and the crankshaft 78 is received through the second bore 106. The linkage halves 100, 102 are connected around the crankshaft 78 and the front support tube 58 using fasteners 94, which are positioned on either side of each bore 104, 106. While the linkage 82 is shown as connected between the front support tube 58 and the crankshaft 78, the linkage 82 may alternatively be connected between the rear support tube 62 and the crankshaft 78.

The fit between the front support tube 58 and the first bore 104 of the linkage 82 may be a slip fit where the front support tube 58 is permitted to spin or rotate within the bore 104 relative to the linkage 82. That is, an inner diameter of the first bore 104 of the linkage 82 is slightly larger compared to an outer diameter of the front support tube 58. Similarly, the fit between the crankshaft 78 and the second bore 106 of the linkage 82 may also be a slip fit where the crankshaft 78 is permitted to spin or rotate within the bore 106 relative to the linkage 82. That is, an inner diameter of the second bore 106 of the linkage 82 is slightly larger compared to an outer diameter of the crankshaft 78. The slip fit configuration of each bore 104, 106 allows the linkage 82 to move linearly as the crankshaft 78 rotates, rather than rotating with the crankshaft 78. As a result, the linkage 82 provides the reciprocating forward and backward gliding motion of the glide assembly 28 through its connection to the front support tube 58.

Figure 7:
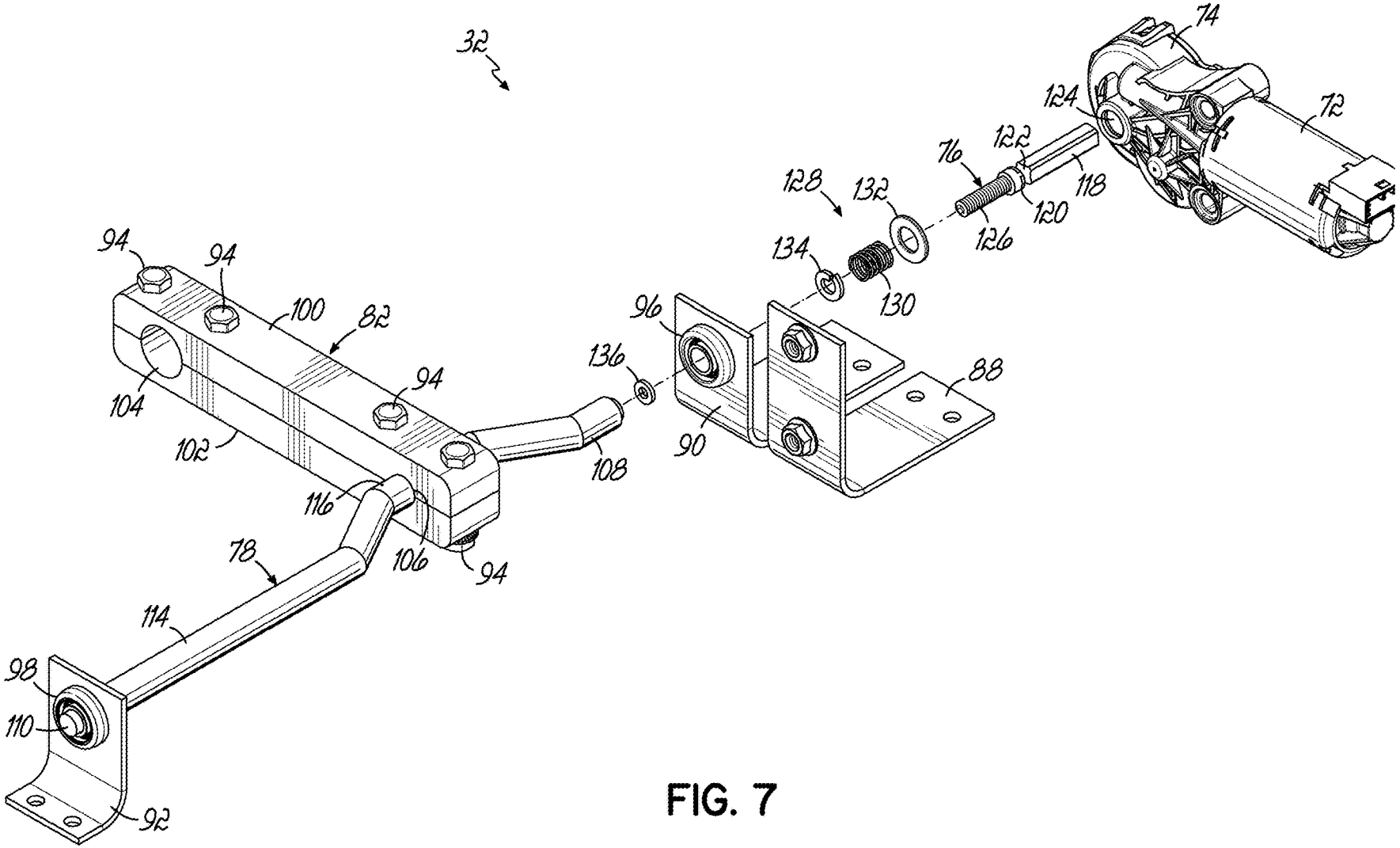
FIG. 7 is a partial disassembled perspective view of the glider drive mechanism of FIGS. 1-6.

With reference now to FIGS. 6 and 7, components of the glider drive mechanism 32 are shown and will now be described in further detail. In that regard, the crankshaft 78 of the glider drive mechanism 32 extends a length between a first end 108 and an opposite second end 110. The first end 108 of the crankshaft 78 is configured to be received by the bearing assembly 96 of the drive shaft support bracket 90 and the second end 110 of the crankshaft 78 is configured to be received by the bearing assembly 98 of the crankshaft support bracket 92. The first end 108 of the crankshaft 78 includes an internally threaded socket 112 (e.g., FIGS. 8A and 8B) that is configured receive a portion of the drive shaft 76 to threadedly connect the crankshaft 78 and drive shaft 76 together, as will be described in further detail below.

With continued reference to FIGS. 6 and 7, the crankshaft 78 includes a main shaft 114 and a crankpin journal 116 axially offset from the main shaft 114. In the embodiment shown, the crankpin journal 116 is adjacent the first end 108 of the crankshaft 78, however, the crankpin journal 116 may be located anywhere along the length of the crankshaft 78. The linkage 82 is attached to the crankpin journal 116 of the crankshaft 78 to convert the rotational motion of the crankshaft 78 into the reciprocating motion of the linkage 82. Specifically, the crankpin journal 116 defines a crank throw CT, as shown in FIG. 6. The crank throw CT is the distance from the axial center of the main shaft 114 of the crankshaft 78 to the axial center of the crankpin journal 116, which determines the stroke of the crankshaft 78. The stroke is the total linear distance that the linkage 82 moves from the top dead center (TDC) of the stroke (e.g., FIG. 8A) to the bottom dead center (BDC) of the stroke (e.g., FIG. 8B). The stroke of the crankshaft 78 should not exceed the maximum forward or backward gliding movement of the seating unit 26 that is permitted by the glide assembly 28.

With continued reference to FIGS. 6 and 7, the drive shaft 76 includes a body 118 and a head 120 separated by an annular groove 122. The body 118 is generally square in transverse cross-sectional shape and is configured to be received within a through socket 124 of the gearbox 74. With brief reference to FIGS. 9A and 9B, for example, the through socket 124 of the gearbox 74 is configured to slidably receive the body 118 of the drive shaft 76, placing the drive shaft 76 in rotational engagement with the gears 84 of the gearbox 74. The through socket 124 may be square or star-shaped, for example. As a result, operation of the motor 72 rotates the gears 84 of the gearbox 74 (e.g., FIGS. 8A and 8B), which in turn rotate the drive shaft 76. However, the through socket 124 configuration permits the drive shaft 76 to slide into or out from the through socket 124 of the gearbox 74 during operation of the glider drive mechanism 32, such as when the glider drive mechanism 32 is operated between the powered gliding mode and the free gliding mode, as will be described in further detail below.

The head 120 of the drive shaft 76 includes an externally threaded male projection 126 that is configured to be threadedly received into the threaded socket 112 at the first end 108 of the crankshaft 78. In this regard, operation of the motor 72 of the glider drive mechanism 32 in the first rotational direction causes the drive shaft 76, specifically the threaded male projection 126, to threadedly engage the crankshaft 78. Once fully threaded into the socket 112, the glider seating unit 10 is placed in the powered gliding mode, and the continued rotation of the drive shaft 76 in the first direction A1 results in the rotation of the crankshaft 78 in the first rotational direction A1.

To place the glider seating unit 10 in the free gliding mode, the motor 72 of the glider drive mechanism 32 is operated in the opposite, second rotational direction, causing the drive shaft 76 to unthread from the crankshaft 78, either partially or fully. As a result, the crankshaft 78 may freely rotate in an oscillating motion relative to the drive shaft 76, moving back and forth through approximately 180 degrees of motion or less, without being restricted by the drive shaft 76, gearbox 74, and motor 72. This permits the glide assembly 28 and the seating unit 26 to glide freely forward and backward relative to the base frame 24.

In an alternative embodiment, the first end 108 of the crankshaft 78 may include the externally threaded male projection 126, while the head 120 of the drive shaft 76 may include the threaded socket 112. In this embodiment, the drive shaft 76 is configured to thread onto the crankshaft 78 to rotationally drive the crankshaft 78. In yet another embodiment, the externally threaded male projection 126 may be a separate threaded pin or rod. The first end 108 of the crankshaft 78 and the head 120 of the drive shaft 76 may each include a socket to receive a respective end of the threaded rod. In that regard, one end of the threaded rod may be secured to either the first end 108 of the crankshaft 78 or the head 120 of the drive shaft 76 with a locknut, allowing the other component to thread onto or off from the opposite end of the threaded rod.

Figure 9A:
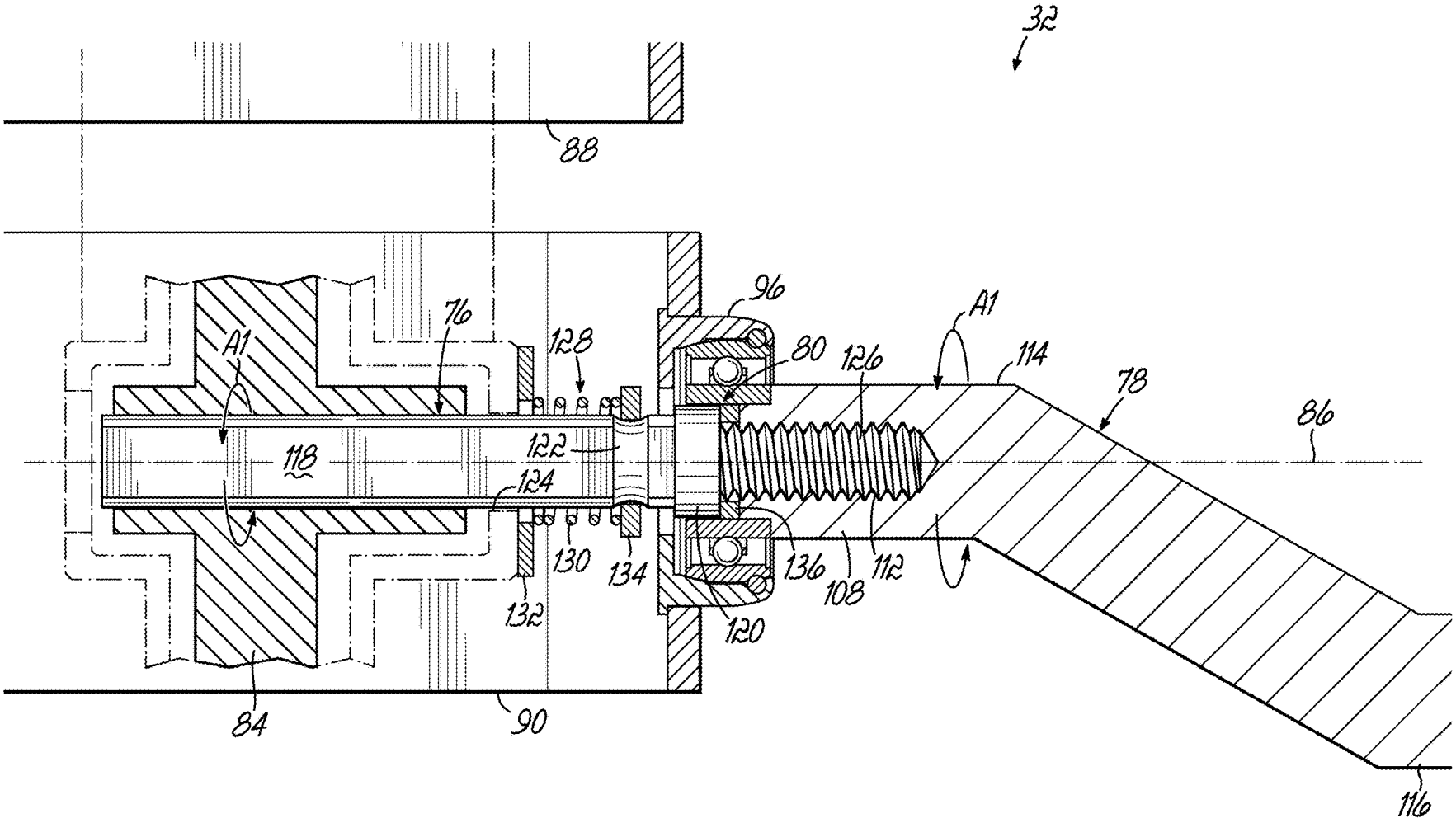
FIG. 9A is an enlarged cross-sectional view of a connection between the drive shaft and the crankshaft of the glider drive mechanism when the glider drive mechanism is in the powered gliding mode.
Figure 9B:
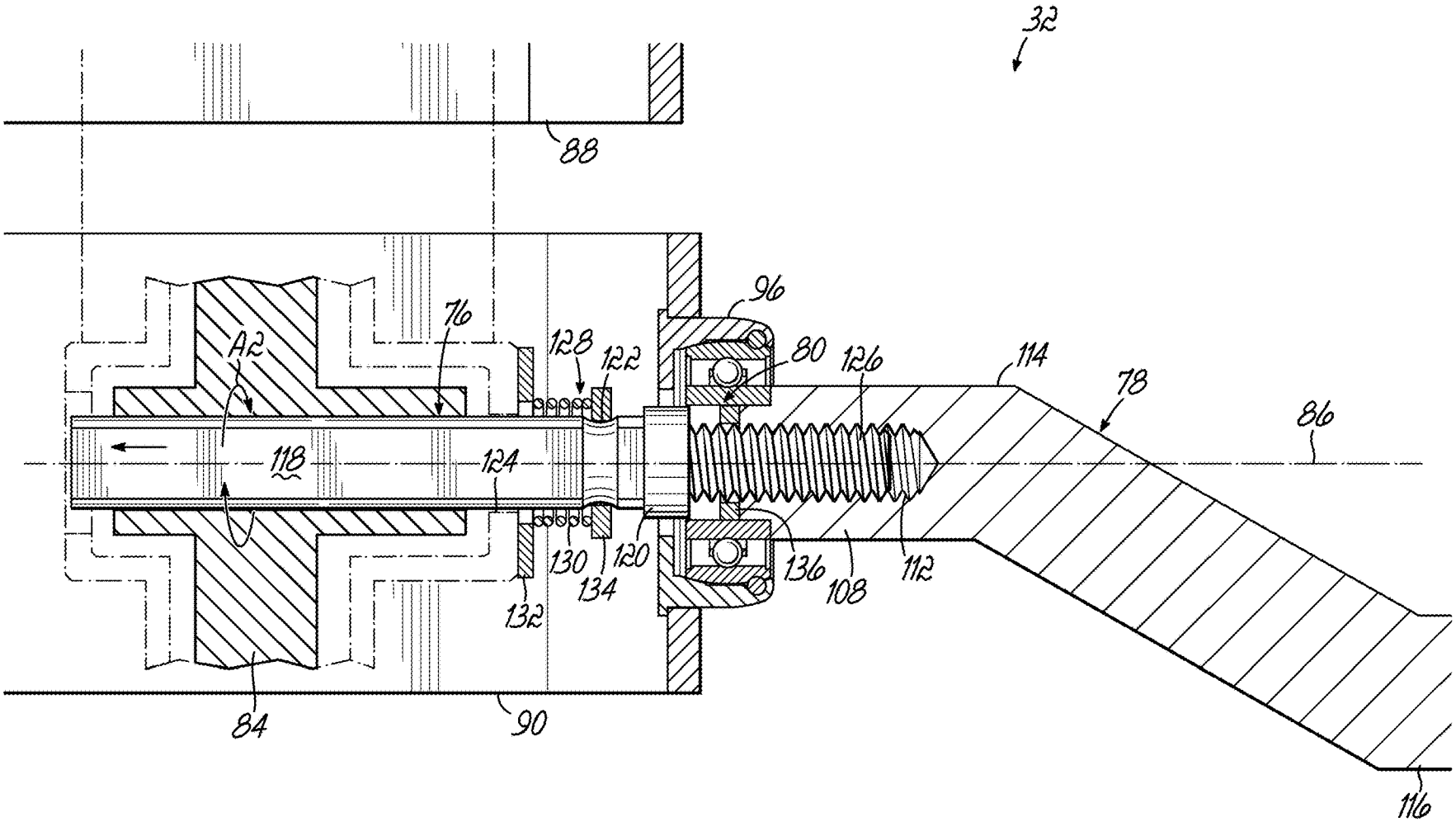
FIG. 9B is a view similar to FIG. 9A, illustrating the drive shaft and the crankshaft of the glider drive mechanism when the glider drive mechanism is in the free gliding mode.

As best shown in FIG. 7, the glider drive mechanism 32 may further include a biasing assembly 128 that is configured to maintain engagement between the drive shaft 76 and the crankshaft 78, particularly when the drive shaft 76 is partially or fully unthreaded from the crankshaft 78. In that regard, the biasing assembly 128 includes a spring 130, such as a coil spring, a washer 132, and a lock washer 134. With brief reference to FIGS. 9A and 9B, for example, the lock washer 134 is configured to be disposed in the annular groove 122 of the drive shaft 76 to generally define an annular collar or shoulder about the drive shaft 76. The washer 132 is configured to be disposed on the drive shaft 76 adjacent the gearbox 74. The spring 130 is also disposed on the drive shaft 76 and is configured to be compressed between the washer 132 at the gearbox 74 and the lock washer 134 on the drive shaft 76. As a result, the spring 130 biases the drive shaft 76 outward from the through socket 124 of the gearbox 74 and into engagement with the crankshaft 78. The glider drive mechanism 32 may further include a washer or bushing 136 that is configured to be positioned at the joint 80 between the drive shaft 76 and the crankshaft 78. As shown in FIGS. 9A and 9B, for example, the washer 136 may generally reside within the bearing assembly 96 of the drive shaft support bracket 90. The bushing 136 may serve to prevent wear or damage from direct contact between the head 120 of the drive shaft 76 and the first end 108 of the crankshaft 78. The washer 136 may also maintain alignment of the externally threaded male projection 126 of the drive shaft 76 with the socket 112 of the crankshaft 78.

Figure 8A:
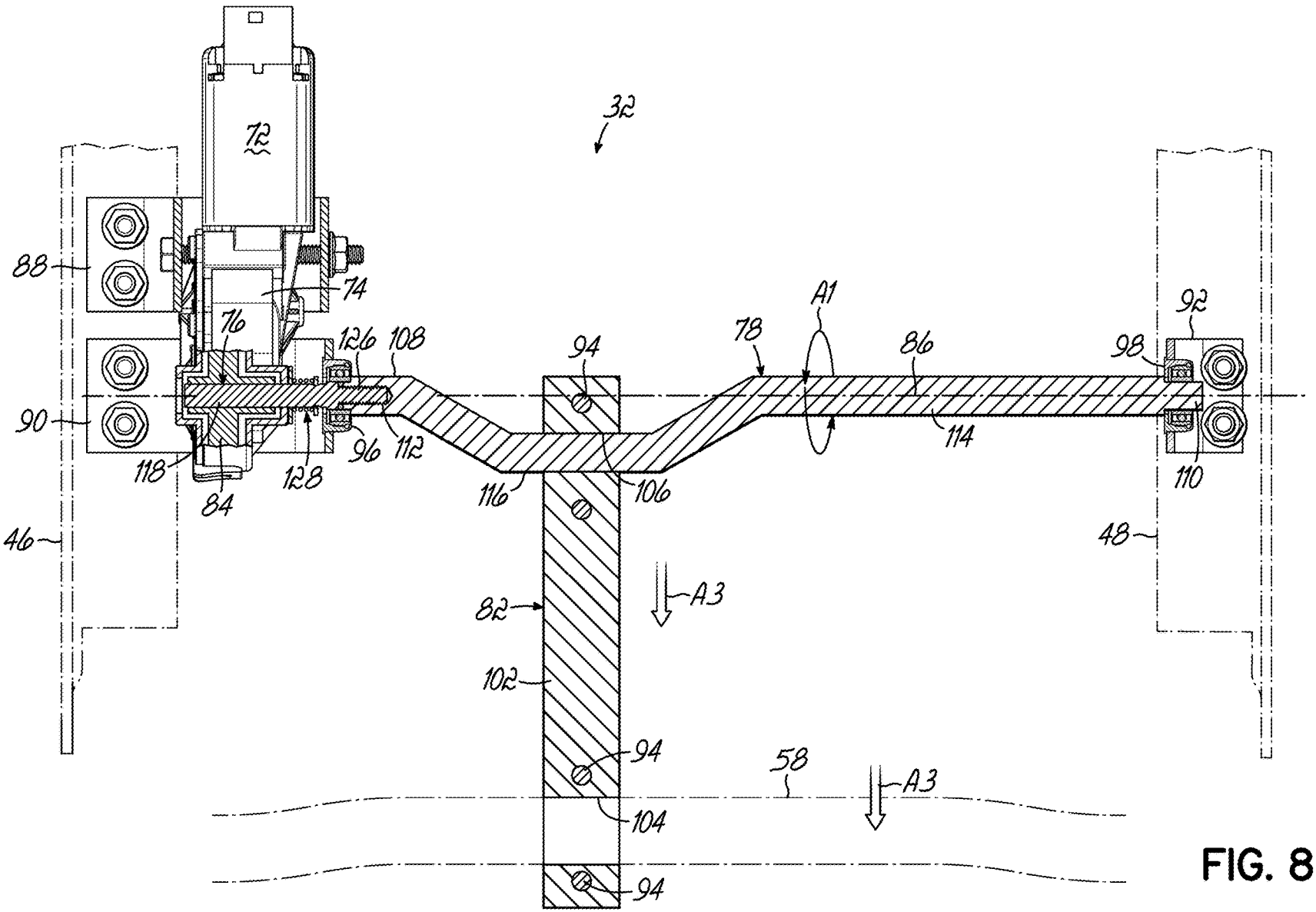
FIGS. 8A and 8B are cross-sectional top views of the glider drive mechanism of FIGS. 1-7, illustrating the glider drive mechanism in a powered gliding mode.
Figure 8B:
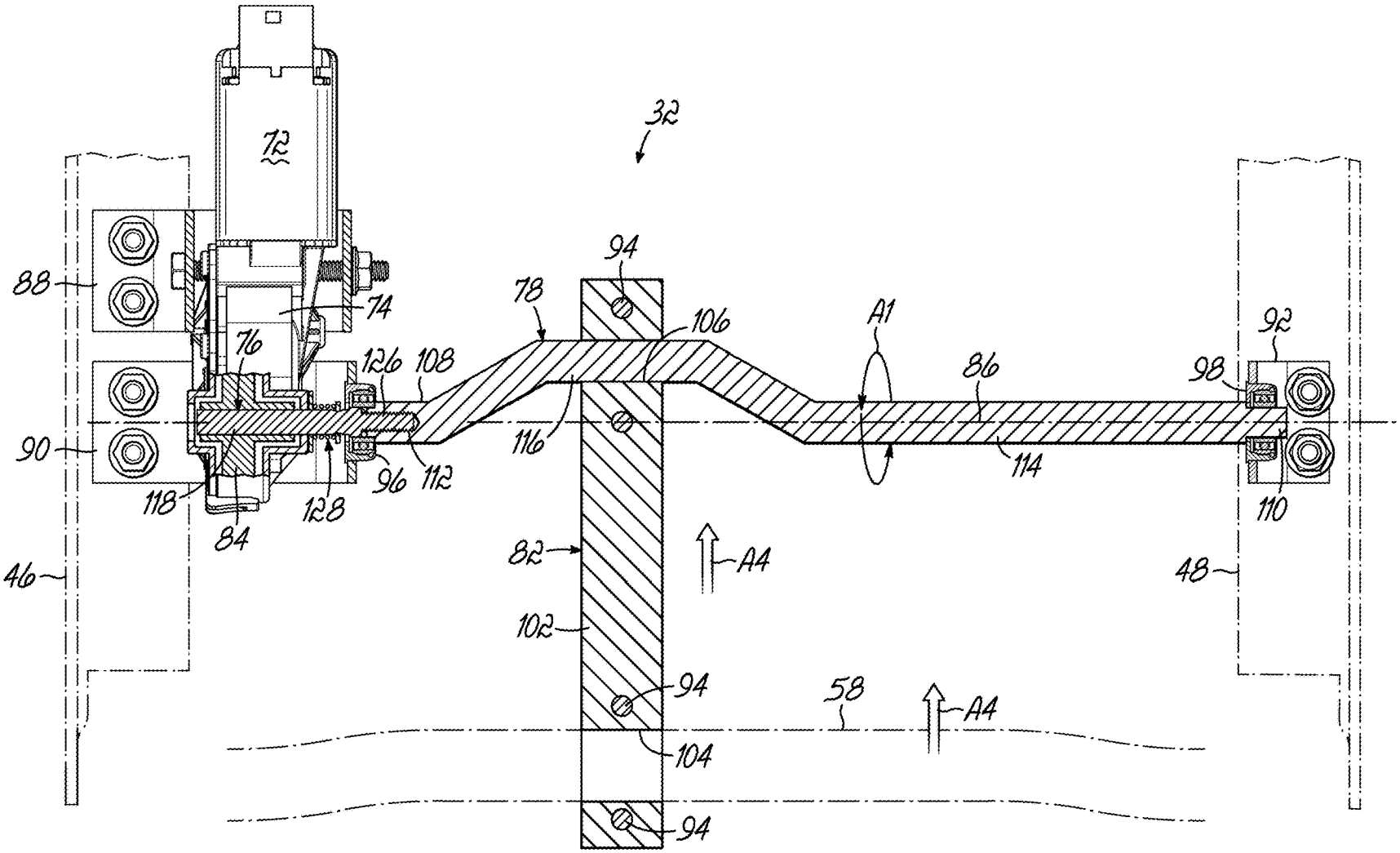

Having now described certain details of the glider drive mechanism 32, methods of operating the glider drive mechanism 32 will now be described with respect to FIGS. 8A-9B according to embodiments of the present invention. With reference to FIGS. 8A and 8B, the glider drive mechanism 32 is arranged in the central space 70 between the base frame 24 and the seating unit 26 and fixedly connected to the base frame 24 via the brackets 88, 90, 92, with the linkage 82 being connected between the crankshaft 78 and the front support tube 58.

An occupant of the glider seating unit 10 may operate the glider drive mechanism 32 to the powered gliding mode using the controller 44 for example. This operation operates the motor 72 of the glider drive mechanism 32 which results in rotation of the drive shaft 76 in the first rotational direction A1. If the glider drive mechanism 32 was previously in free gliding mode, rotation of the drive shaft 76 in the first rotational direction A1 threads the externally threaded male projection 126 of the drive shaft 76 into the socket 112 of the crankshaft 78, as best shown in FIG. 9A. If the glider drive mechanism 32 was previously in power gliding mode, the drive shaft 76 may already be connected to the crankshaft 78. In either case, once the externally threaded male projection 126 of the drive shaft 76 is fully threaded into the socket 112 to connect the drive shaft 76 to the crankshaft 78, the continued rotation of the drive shaft 76 in the first direction A1 results in the rotation of the crankshaft 78 in the first rotational direction A1. Rotation of the crankshaft 78 in the first rotational direction A1 induces reciprocating forward A3 and rearward A4 linear motion of the linkage 82, as described above, resulting in the forward A3 and rearward A4 linear motion of the glide assembly 28. Specifically, as the crankshaft 78 rotates, the crankpin journal 116 moves between the top dead center (TDC) of the stroke, as shown in FIG. 8A, to the bottom dead center (BDC) position of the stroke, as shown in FIG. 8B. The TDC of the stroke may be the forward most position of the crankpin journal 116 relative to the base frame 24. When at the TDC of the stroke, the seating unit 26 may be at the forward most position of the gliding motion. The BDC position may be the rearward most position of the crankpin journal 116 relative to the base frame 24. When at the BDC of the stroke, the seating unit 26 may be at the rearward most position of the gliding motion.

Figure 8C:
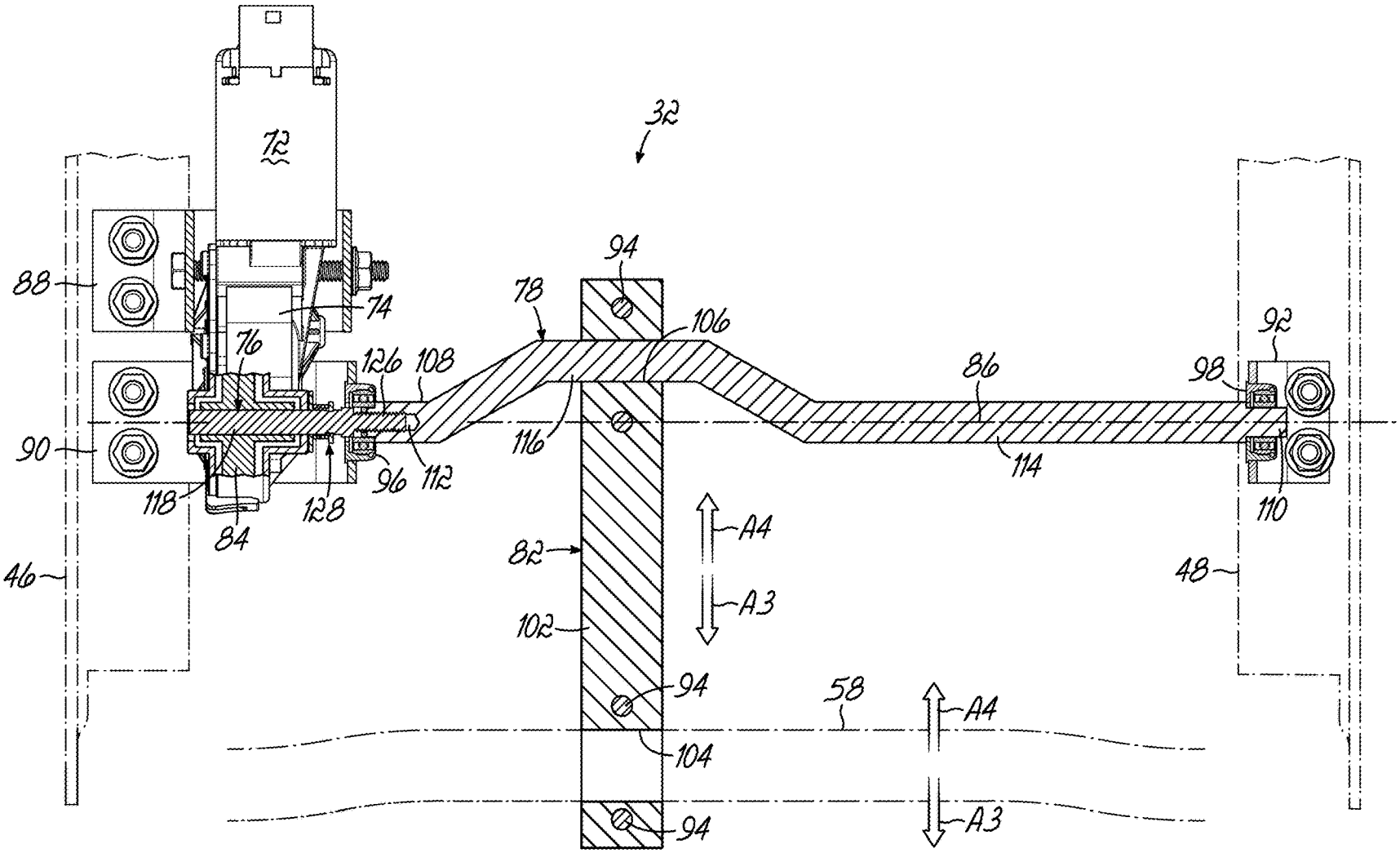
FIG. 8C is a view similar to FIGS. 8A and 8B, illustrating the glider drive mechanism in a free gliding mode.

The occupant may stop the power gliding mode using the controller 44. The occupant may also switch from the power gliding mode to the free gliding mode using the controller 44. This operation operates the motor 72 of the glider drive mechanism 32 which results in rotation of the drive shaft 76 in the second rotational direction A2. As best shown in FIG. 9B, rotation of the drive shaft 76 in the second rotational direction A2 causes the externally threaded male projection 126 of the drive shaft 76 to unthread from the socket 112 of the crankshaft 78. The programming of the controller 44 may be such that operation of the controller 44 to command the glider drive mechanism 32 to the free gliding mode partially or fully unthreads the externally threaded male projection 126 from the socket 112 of the crankshaft 78. As shown in FIG. 9B, the externally threaded male projection 126 is only partially unthreaded from the crankshaft 78 socket 112. In the free gliding mode, the drive shaft 76 remains engaged with the crankshaft 78 at the joint 80, but the crankshaft 78 is functionally disconnected from the drive shaft 76. In that regard, the externally threaded male projection 126 is unthreaded enough to allow the crankshaft 78 to freely rotate in an oscillating motion, moving back and forth through approximately 180 degrees or less, without being limited by the stationary drive shaft 76. As a result, the glider drive mechanism 32 and thus the seating unit 26 is permitted to glide freely in a forward direction A3 and backward direction A4 without restriction from the glider drive mechanism 32, as shown in FIG. 8C.

As best shown in FIG. 9B, when the drive shaft 76 is unthreaded from the crankshaft 78, the drive shaft 76 is permitted to slide through the through socket 124 of the gearbox 74 in a direction away from the crankshaft 78. This sliding motion of the drive shaft 76 further compresses the spring 130 of the biasing assembly 128 between the washer 132 and the lock washer 134, increasing the biasing force exerted by the spring 130 on the drive shaft 76. The biasing force is configured to force the drive shaft 76 outward from the through socket 124 of the gearbox 74 and toward the crankshaft 78. This maintains the alignment of the externally threaded male projection 126 of the drive shaft 76 with the socket 112 of the crankshaft 78 and facilitates the threading of the male projection 126 into the socket 112 when the drive shaft 76 is rotated in the first rotational direction A1. To that end, the biasing assembly 128 ensures that the externally threaded male projection 126 remains aligned and able to thread into the socket 112, thereby enabling the glider seating unit 10 to be placed in the powered gliding mode.

In one embodiment, operation of the controller 44 to move the glider seating unit 10 to the reclined position results in first operating the motor 72 of the glider drive mechanism 32 to rotate the drive shaft 76 in the first rotational direction A1 to threadedly connect the drive shaft 76 to the crankshaft 78 to prevent the glide assembly 28 from freely gliding forward and backward relative to the base frame 24 when the seating unit 26 is in the reclined position. Once the drive shaft 76 is operationally connected to the crankshaft 78, as shown in e.g., FIG. 9A, the motor 72 is turned off. As a result, the glider seating unit 10 is prevented from gliding freely as a result of any rotational movement of the crankshaft 78 being restricted by the motor 72 and gearbox 74 combination. Once in the reclined position, the occupant may use the controller 44 to place the glider drive mechanism 32 in the powered gliding mode, thereby inducing reciprocating forward and rearward gliding motion of the glide assembly 28 relative to the base frame 24, as described above. Furthermore, once the glider seating unit 10 is operated back to the upright position, the occupant may use the controller 44 to place the glider drive mechanism 32 in free gliding mode.

While the releasable connection between the drive shaft 76 and the crankshaft 78 is shown and described as being a threaded connection, it is understood that other suitable structures and connection methods may be employed to selectively connect and disconnect the crankshaft 78 and the drive shaft 76, such as a magnetic decoupler. In that regard, the magnetic decoupler may be energized to connect the crankshaft 78 to the drive shaft 76 such that operation of the motor 72 induces reciprocating forward and rearward gliding motion of the glide assembly 28 and thus the seating unit 26 relative to the base frame 24. The magnetic decoupler may be de-energized to disconnect the drive shaft 76 from the crankshaft 78 to permit the glide assembly 28 and thus the seating unit 26 to glide freely forward and backward relative to the base frame 24.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of those features. Accordingly, the scope of the invention shall be limited only by the following claims and their equivalents.

What is claimed is:

1. A glider seating unit, comprising:

a base frame;

a glide assembly connected to the base frame and being configured to glide in a forward direction and in a backward direction relative to the base frame; and a glider drive mechanism connected to the base frame, the glider drive mechanism comprising:

a motor;

a drive shaft connected to the motor;

a crankshaft releasably connected to the drive shaft at a joint; and a linkage connected between the crankshaft and the glide assembly;

wherein the glider drive mechanism is configured to be operated to connect the crankshaft to the drive shaft such that operation of the motor induces reciprocating forward and backward gliding motion of the glide assembly relative to the base frame, and wherein the glider drive mechanism is configured to be operated to disconnect the drive shaft from the crankshaft to permit the glide assembly to glide freely forward and backward relative to the base frame.

2. The glider seating unit of claim 1, wherein operation of the motor of the glider drive mechanism in a first rotational direction is configured to connect the drive shaft to the crankshaft to rotate the crankshaft to induce reciprocating forward and backward gliding motion of the glide assembly relative to the base frame, and wherein operation of the motor of the glider drive mechanism in an opposite, second rotational direction is configured to disconnect the drive shaft from the crankshaft to permit the glide assembly to glide freely forward and backward relative to the base frame.

3. The glider seating unit of claim 1, wherein the crankshaft includes a main shaft and a crankpin journal offset from the main shaft to define a crank throw, the linkage being connected to the crankpin journal of the crankshaft.

4. The glider seating unit of claim 2, wherein the connection between the drive shaft and the crankshaft is threaded such that operation of the motor of the glider drive mechanism in the first rotational direction causes the drive shaft to threadedly engage the crankshaft and operation of the motor of the glider drive mechanism in the second rotational direction causes the drive shaft to unthread from the crankshaft.

5. The glider seating unit of claim 4, wherein the crank shaft includes a threaded socket that is configured to threadedly receive an externally threaded male connector of the drive shaft at the joint.

6. The glider seating unit of claim 1, wherein the glider drive mechanism further comprises:

a first support bracket that includes a bearing assembly, the first support bracket being connected the base frame; and a second support bracket that includes a bearing assembly, the second support bracket being connected the base frame;

wherein a first end of the crankshaft is rotatably supported by the first support bracket and a second end of the crankshaft is rotatably supported by the second support bracket.

7. The glider seating unit of claim 6, wherein the glide assembly includes a first glide bracket and a second glide bracket, and wherein the first support bracket is connected to the first glide bracket and the second support bracket is connected to the second glide bracket.

8. The glider seating unit of claim 7, wherein the motor is attached to the first glide bracket with a motor support bracket.

9. The glider seating unit of claim 7, wherein the first glide bracket is located on a first side of the glider seating unit and the second glide bracket is located on an opposite, second side of the glider seating unit such that a rotational axis of the crankshaft is generally perpendicular to the first side and the second side of the glider seating unit.

10. The glider seating unit of claim 7, wherein the first glide bracket and the second glide bracket each include at least one swing link, and the glide assembly further includes at least one cross brace connected between the at least one swing link of the first glide bracket and the at least one swing link of the second glide bracket, and wherein the linkage is connected between the crankshaft and the at least one cross brace.

11. The glider seating unit of claim 1, wherein the glider drive mechanism further comprises a spring disposed on the drive shaft, the spring being positioned between the motor and a collar on the drive shaft to bias the drive shaft into engagement with the crankshaft.

12. The glider seating unit of claim 1, further comprising a seating unit connected to the glide assembly, the seating unit being movable between an upright position and a reclined position.

13. The glider seating unit of claim 12, wherein the glider drive mechanism is configured to be operated to connect the drive shaft to the crankshaft when the seating unit is moved to the reclined position.

14. A method of operating a glider seating unit, comprising:

providing the glider seating unit, comprising:

a base frame;

a glide assembly connected to the base frame and being configured to glide in a forward direction and in a backward direction relative to the base frame; and a glider drive mechanism connected to the base frame, the glider drive mechanism comprising:

a motor;

a drive shaft connected to the motor;

a crankshaft releasably connected to the drive shaft at a joint; and a linkage connected between the crankshaft and the glide assembly;

operating the motor of the glider drive mechanism to rotate the drive shaft in a first rotational direction to connect the drive shaft to the crankshaft;

operating the motor in the first rotational direction to induce reciprocating forward and rearward gliding motion of the glide assembly relative to the base frame; and operating the motor in a second rotational direction to disconnect the drive shaft from the crankshaft to permit the glide assembly to glide freely forward and backward relative to the base frame.

15. The method of claim 14, wherein the connection between the drive shaft and the crankshaft is threaded, the method further comprising:

operating the motor in the first rotational direction to threadedly engage the drive shaft to the crankshaft; and operating the motor in the second rotational direction to unthread the drive shaft from the crankshaft.

16. The method of claim 15, wherein operating the motor in the second rotational direction to unthread the drive shaft from the crankshaft results in the drive shaft only partially unthreading from the crankshaft.

17. The method of claim 14, wherein the glider seating unit further comprises a seating unit connected to the glide assembly, the seating unit being movable between an upright position and a reclined position, the method further comprising:

moving the seating unit to the reclined position; and operating the motor of the glider drive mechanism to rotate the drive shaft in the first rotational direction to connect the drive shaft to the crankshaft to prevent the glide assembly from freely gliding forward and backward relative to the base frame when the seating unit is in the reclined position.

18. The method of claim 17, further comprising:

operating the motor in the first rotational direction to induce reciprocating forward and rearward gliding motion of the glide assembly relative to the base frame while the seating unit is in the reclined position.

19. The method of claim 17, further comprising:

moving the seating unit to the upright position; and operating the motor in the second rotational direction to disconnect the drive shaft from the crankshaft to permit the glide assembly to glide freely forward and backward relative to the base frame while the seating unit is in the upright position.

20. A glider drive mechanism for a glider seating unit that includes a base frame and a glide assembly movably connected to the base frame and being configured to glide in a forward direction and in a backward direction relative to the base frame, the glider drive mechanism comprising:

a motor connected to the base frame;

a drive shaft connected to the motor;

a crankshaft releasably connected to the drive shaft at a joint; and a linkage configured to be connected between the crankshaft and the glide assembly of the glider seating unit;

wherein the glider drive mechanism is configured to be operated to connect the crankshaft to the drive shaft such that operation of the motor is configured to induce reciprocating forward and backward gliding motion of the glide assembly relative to the base frame, and wherein the glider drive mechanism is configured to be operated to disconnect the drive shaft from the crankshaft such that the glide assembly is configured to glide freely forward and backward relative to the base frame.

21. The glider drive mechanism of claim 20, wherein operation of the motor of the glider drive mechanism in a first rotational direction is configured to connect the drive shaft to the crankshaft to rotate the crankshaft to induce reciprocating forward and backward gliding motion of the glide assembly relative to the base frame, and wherein operation of the motor of the glider drive mechanism in an opposite, second rotational direction is configured to disconnect the drive shaft from the crankshaft to permit the glide assembly to glide freely forward and backward relative to the base frame.

22. The glider drive mechanism of claim 20, wherein the crankshaft includes a main shaft and a crankpin journal offset from the main shaft to define a crank throw, the linkage being connected to the crankpin journal of the crankshaft.

23. The glider drive mechanism of claim 20, wherein the connection between the drive shaft and the crankshaft is threaded such that operation of the motor of the glider drive mechanism in the first rotational causes the drive shaft to threadedly engage the crankshaft and operation of the motor of the glider drive mechanism in the second rotational direction causes the drive shaft to unthread from the crankshaft.

24. The glider drive mechanism of claim 23, wherein the crank shaft includes a threaded socket that is configured to threadedly receive an externally threaded male connector of the drive shaft at the joint.

25. The glider drive mechanism of claim 20, further comprising:

a first support bracket that includes a bearing assembly, the first support bracket being connected the base frame; and a second support bracket that includes a bearing assembly, the second support bracket being connected the base frame;

wherein a first end of the crankshaft is rotatably supported by the first support bracket and a second end of the crankshaft is rotatably supported by the second support bracket.

26. The glider drive mechanism of claim 20, further comprising a spring disposed on the drive shaft, the spring being positioned between the motor and a collar on the drive shaft to bias the drive shaft into engagement with the crankshaft.

* * * * *